US009293312B2

(12) United States Patent
Remes et al.

(10) Patent No.: US 9,293,312 B2
(45) Date of Patent: Mar. 22, 2016

(54) IDENTIFYING THE OCCURRENCE AND LOCATION OF CHARGING IN THE ION PATH OF A MASS SPECTROMETER

(71) Applicant: Thermo Finnigan LLC, San Jose, CA (US)

(72) Inventors: Philip M. Remes, Berkeley, CA (US); Michael W. Senko, Sunnyvale, CA (US); Michael W. Belford, Los Altos, CA (US); Jae C. Schwartz, Gilroy, CA (US); Jean-Jacques Dunyach, San Jose, CA (US); Berg Tehlirian, Daly City, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/216,507

(22) Filed: Mar. 17, 2014

(65) Prior Publication Data

US 2014/0264007 A1 Sep. 18, 2014

Related U.S. Application Data

(60) Provisional application No. 61/787,385, filed on Mar. 15, 2013.

(51) Int. Cl.
*H01J 49/00* (2006.01)

(52) U.S. Cl.
CPC ..... *H01J 49/0031* (2013.01)

(58) Field of Classification Search
CPC ..... H01J 49/0027; H01J 49/0031
USPC ..... 250/282
See application file for complete search history.

(56) References Cited

U.S. PATENT DOCUMENTS

2002/0190201 A1* 12/2002 Yamada ..... H01J 49/168 250/288
2004/0041090 A1* 3/2004 Bloomfield ..... H01J 49/063 250/282
2006/0237641 A1* 10/2006 Moeller ..... H01J 49/14 250/288
2010/0171032 A1* 7/2010 Wang ..... H01J 49/0036 250/282
2011/0012013 A1* 1/2011 Remes ..... H01J 49/0009 250/252.1
2012/0228489 A1* 9/2012 Hohndorf ..... H01J 49/0009 250/282

OTHER PUBLICATIONS

Girard, E., et. al., "Determination of Quadrupole Charging in MS/MS Instruments" Journal of Chromatographic Science, vol. 48, Oct. 2010.*

* cited by examiner

*Primary Examiner* — Wyatt Stoffa
(74) *Attorney, Agent, or Firm* — Charles B. Katz

(57) ABSTRACT

A method is described for identifying the occurrence and location of charging of ion optic devices arranged along the ion path of a mass spectrometer. The method includes repeatedly performing a sequence of introducing a beam of discharge ions to a location on the ion path, and subsequently measuring the intensities of opposite-polarity sample ions delivered to a mass analyzer, with the discharge ions being delivered to a location further downstream in the ion path at each successive sequence.

9 Claims, 4 Drawing Sheets

IDENTIFYING THE OCCURRENCE AND LOCATION OF CHARGING IN THE ION PATH OF A MASS SPECTROMETER

CROSS-REFERENCE TO RELATED APPLICATION

This application claims the priority benefit of U.S. Provisional Patent Application No. 61/787,385 entitled "Localizing Charged Contamination in a Mass Spectrometer", filed Mar. 15, 2013, the disclosure of which is incorporated herein by reference.

FIELD OF THE INVENTION

The present invention relates generally to mass spectrometers, and more particularly to a method for identifying the location of charging in a mass spectrometer.

BACKGROUND

The three basic tasks of a mass spectrometer are to generate ionic, gaseous versions of analytes in a source, transfer the analyte ions from the source through several differential pumping regions, and finally measure the abundance and mass-to-charge ratios (m/z's) of the analyte ions or product ions derived therefrom. The movement of ions from one location to another in the instrument is controlled primarily through the application of oscillatory and/or static voltages to the various ion transfer optic devices (e.g., radio-frequency multipoles, stacked-ring ion guides, and electrostatic lenses) to establish electric fields that radially confine the ions to a central ion path and urge the ions along a longitudinal trajectory from regions of higher to lower potential energy. As is well known in the mass spectrometry art, these ion transfer optic devices must be kept clean and free from particles and debris, which can cause degradation of instrument performance, by a process commonly referred to as "charging", leading to loss of sensitivity. The mechanism of degradation of instrument performance is thought to occur in two steps. Contamination is introduced onto an optical element of the ion path in one of several ways, e.g., from the room environment or device mishandling when the instrument was open for service, or from the atmospheric ionization source while the instrument was under vacuum. When ions subsequently impinge on these non-conductive contaminants, their charge can dissipate only slowly. Over time, enough charge can accumulate to create a voltage potential leading to a significant aberration in the local electrical field, such that new ions are either deflected away from their intended path, or blocked completely. Such aberrations often have mass-dependent effects, whereby ions of different m/z's are affected disproportionately. Small particles like dust and fibers have high aspect ratios, such that large electric fields can be generated from small numbers of impinging ions, and so charging occurs fairly rapidly once they are exposed to ions. As instrument developers strive to increase instrument sensitivity, atmospheric ionization source orifices grow ever larger, increasing the probability of contaminants entering the system and potentially causing contamination and charging to occur faster, requiring the instrument to be serviced more frequently.

If an instrument shows signs of sensitivity decrease, the presence of charging is commonly diagnosed by the method of switching instrument polarity, i.e., by switching the polarity, e.g., from positive to negative, of analyte ions produced by the source and delivered through the ion transfer optic devices to the mass analyzer. In an illustrative example, decreased instrument sensitivity may be suspected when operating a mass spectrometer to analyze positive analyte ions. When the instrument is switched from positive, to negative, and back to positive polarity, the instrument sensitivity may be temporarily restored (due to the rapid neutralization of positively charged ion transfer optic surfaces by the impingement thereon of negative ions) and so monitoring ion abundance during this procedure will show a characteristic jump in intensity. This method can help to discern the presence of contamination somewhere in the instrument, but cannot be more precise.

Against this background, there is a continuing need for a method for identifying the specific location of the occurrence of charging within a mass spectrometer.

SUMMARY

Roughly described, an embodiment of the present invention provides a method for identifying the location of a charging element disposed in the ion path of a mass spectrometer, the ion path extending from an ion source to a mass analyzer. The method includes an initial step of directing ions of a first type (e.g., positive ions generated from an analyte substance) along the ion path, and measuring the intensities of the ions delivered to the mass analyzer. The method then includes directing ions of a second type, having a polarity opposite to the ions of the first type, along a segment of the ion path terminating at an intermediate location in the mass spectrometer. The mass spectrometer is then operated to again direct ions of the first type along the ion path. The sequence of steps of directing the ions of the second type (e.g., negative ions) to an intermediate location and subsequently re-measuring the intensities of the opposite polarity ions may be repeated for a set of intermediate locations extending progressively farther down the ion path toward the mass analyzer, such that the corresponding segment of the ion path along which the ions of the second type are directed includes one or more additional ion transfer optic devices relative to the previous sequence of steps. The intermediate locations may be established by applying a suitable blocking potential to an ion transfer optic component disposed immediately downstream of the intermediate location, thereby preventing the further travel of the ions of the second type along the ion path. By determining the intermediate location at which an increase in the re-measured ion intensity is first observed, the ion optic transfer device(s) that have been charging and causing reduced ion transmission/sensitivity may be easily identified. The method may include a further step of displaying the results of the foregoing steps to the instrument operator, e.g., via a user interface displayed on a computer monitor and an indication as to which ion optic transfer device(s) have been identified as the locality of the charging. The steps of the method may be carried out by an instrument controller configured with suitable hardware and/or software logic.

DETAILED DESCRIPTION OF EMBODIMENTS

Figure 1:
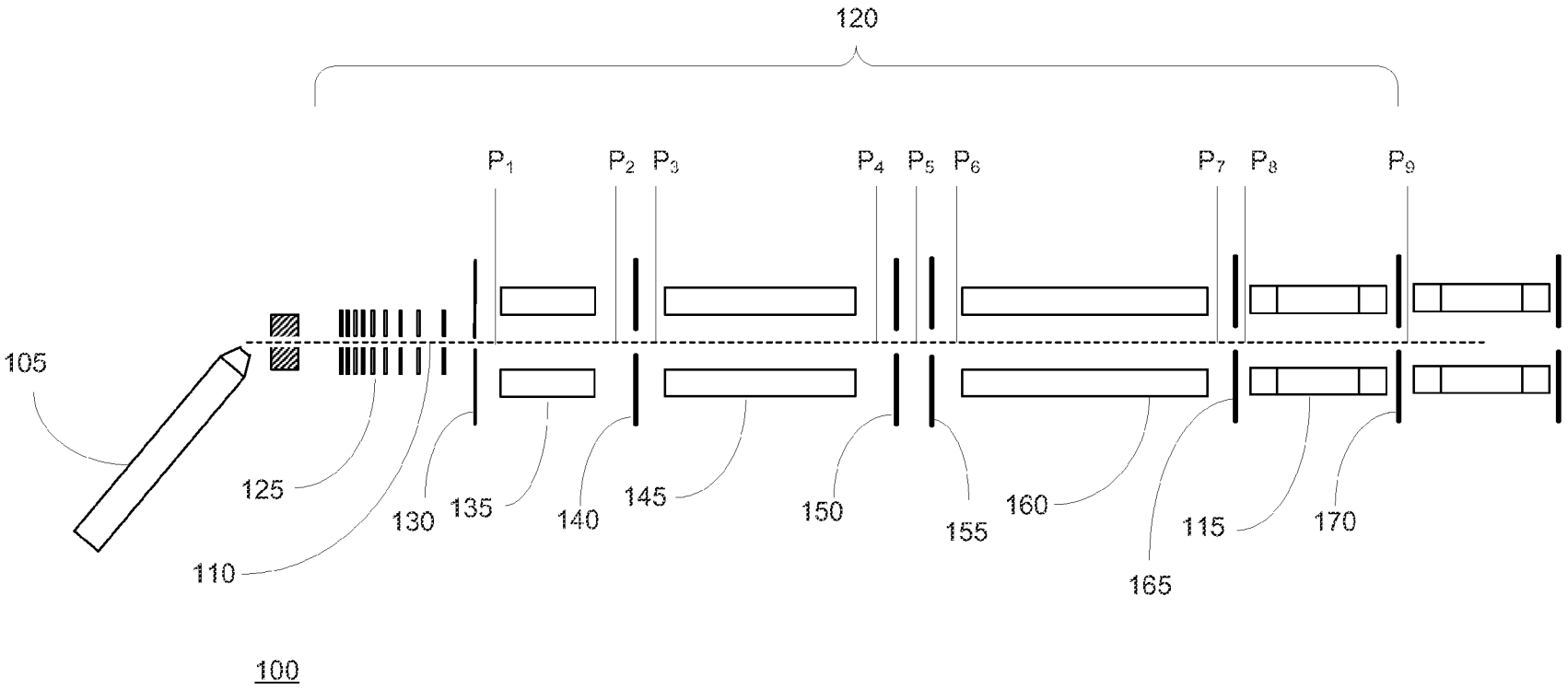
FIG. 1 is a symbolic diagram of a mass spectrometer.

FIG. 1 symbolically depicts components of a mass spectrometer 100 in which the occurrence and location of charging may be identified, in accordance with methods provided by the present invention. Mass spectrometer 100 includes an ion source 105 that generates ions from an analyte-containing sample stream, for example the eluant from a liquid chromatography (LC) column. Ion source 105 may take the form of an electrospray ionization (ESI) source, in which the sample stream is introduced as a spray of electrically charged droplets, and gas-phase analyte ions are produced as the result of droplet evaporation, Coulomb fission and charge transfer. In one implementation, ion source 105 may be utilized for production of both the ions of the first and second types described below (e.g., positively charged analyte ions and negatively charged discharge ions) from a common sample stream. For an ESI source, the polarity of ions generated by the source and propagated along the ion path may be switched by changing the voltage applied to the source capillary, as well as the voltages applied to electrodes of the ion transfer optic devices located downstream in the ion path. In other implementations of the invention, the positive and negative ions may be generated by separate sources; for example, analyte ions may be generated in an ESI source, and oppositely-charged discharge ions may be formed in a Townsend discharge source located adjacent to or downstream of the ESI source; in such implementations, the polarity of ions to be conveyed along the ion path is selected by switching between operation of the two sources, or by blocking the progress of ions of one polarity while allowing the progress of the other by applying appropriate voltages to the ion transfer optic devices, as described below.

Ions produced by ion source 105 are conveyed along an ion path 110 extending from ion source 105 through a series of chambers maintained at successively lower pressures to a mass analyzer 115. In the present example, mass analyzer 115 consists of a dual cell two-dimensional ion trap mass analyzer, of the type described in U.S. Pat. No. 7,692,142 by Schwartz, et al. A set of ion transfer optic devices, collectively numbered 120, are arranged along ion path 110 and function, via the generation of oscillatory (e.g., radio-frequency (RF)) and electrostatic fields, to radially confine and focus ions to ion path 110, as well as urge the ions to travel in the direction of mass analyzer 115, such that the ions are efficiently transferred thereto. Certain of the ion transfer optic devices may perform or facilitate additional functions, such as ion beam gating, mass selection or filtering, and collisional dissociation. In general, ion transfer optic devices 120 consist of structures each having one or more electrodes to which oscillatory and/or static (DC) voltages of controllable amplitude and polarity are applied. The voltages are applied to the electrodes of ion transfer optic devices by means of a set of voltage sources (not depicted in FIG. 1) which operate under the control of a voltage controller (also not depicted). The voltage controller forms part of a control and data system, which functions to control and manage the various operations of mass spectrometer 100 as well as store and process mass spectral data acquired by mass analyzer 115. The control and data system will typically be distributed across several physical devices, including specialized and general-purpose processors, application-specific integrated circuits, memory and storage, and is programmed with hardware and/or software logic for executing instructions that implement the various operations and acquisition/processing steps. In a typical embodiment of the present invention, the method for determining the existence and location of charging within mass spectrometer 100 is encoded as a software program, stored in the memory of the control and data system, that is executed by one or more processors. The control and data system will also typically include a monitor for visually displaying data and results to the operator, as well as one or more input devices to allow the operator to enter information and select desired functions, e.g., through a user interface.

In the present example, ion transfer optics devices 120 include a progressively spaced stacked-ring ion guide (SRIG) 125 (of the type described in U.S. Pat. No. 7,514,673 by Senko, et al.), a SRIG exit lens 130, a first RF multipole 135, a first lens 140, a second RF multipole 145, a second lens 150, a split-lens gate 155, a third RF multipole 160, and a trap entrance lens 165. As depicted, mass analyzer 115 includes a center lens 170, which controls the transfer of ions between the first (high-pressure) and second (low-pressure) cells of the dual-cell linear trap. As is described in further detail below, the voltage controller, by application of an appropriate blocking voltage to a selected ion transfer optic device, is operable to stop the travel of discharge ions along the ion path, such that only a subset of the ion transfer optic devices are exposed to the impingement of discharge ions.

During normal operation of mass spectrometer 100, ions of a first type (referred to herein as analyte ions) are generated by ion source 105 and are delivered along ion path 110 to mass analyzer 115, which is operated to acquire mass spectra representative of the abundances and m/z's of the analyte ions, for example by a mass-sequential scanning technique. As described above, charging of one or more of the ion transfer optic devices, resulting from surface contamination and slow charge dissipation, creates field aberrations that interfere with the efficient transmission of ions along ion path 110, such that reduced numbers of ions are delivered to mass analyzer 115. This condition produces a consequent reduction in the overall instrument sensitivity particularly with respect to ion species whose trajectories are disproportionately affected by the presence of the field aberrations. The method described below, with reference to FIG. 2, provides a technique for identifying the presence and location of charging within mass spectrometer, which enables the operator to recognize the condition and take corrective action.

Figure 2:
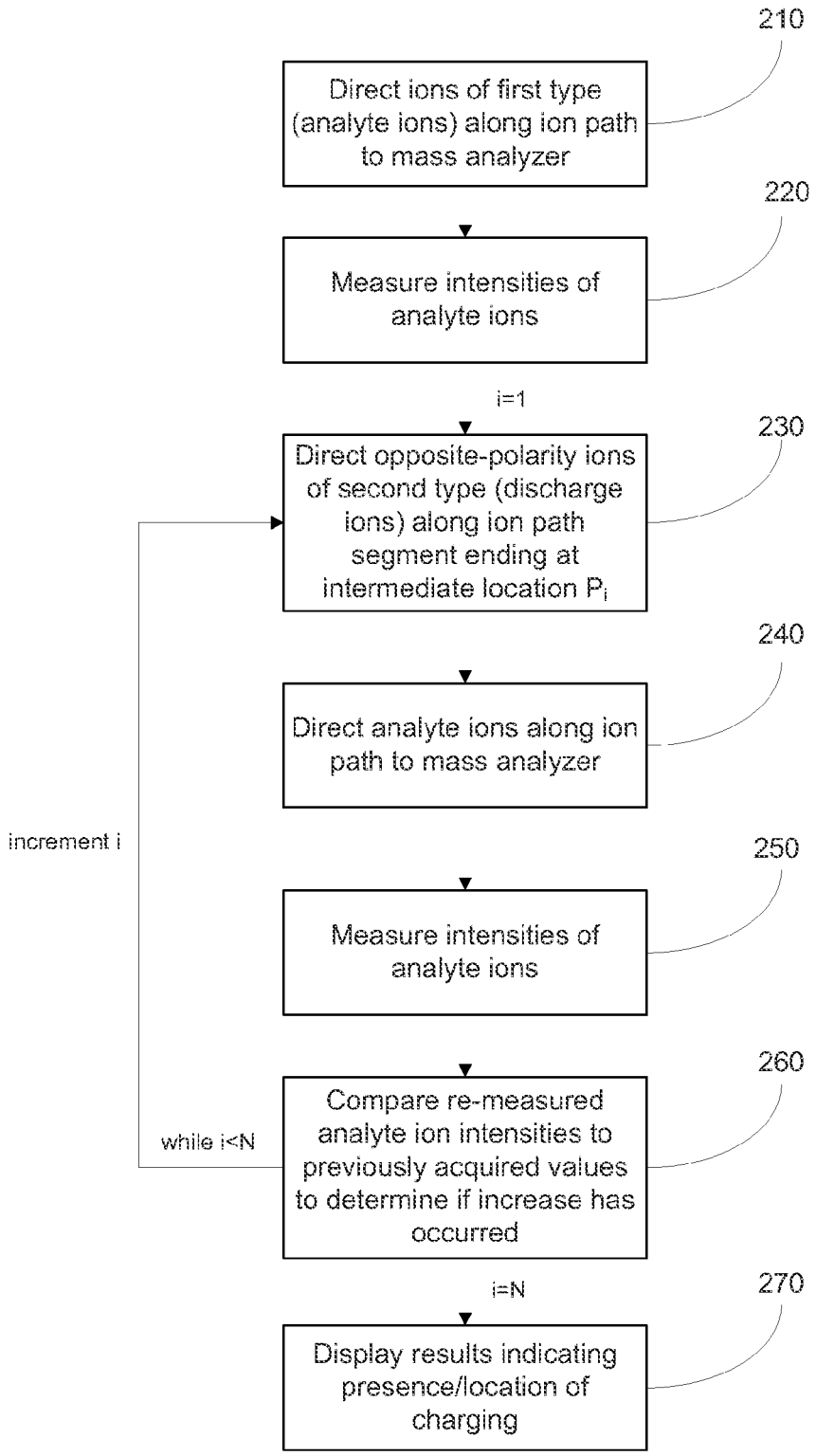
FIG. 2 is a flowchart depicting the steps of a method for determining the occurrence and location of charging along the ion path of a mass spectrometer.

The method depicted in FIG. 2 may be initiated by operator action (e.g., when reduced sensitivity indicative of charging is suspected), or may be initiated automatically by the control and data system at regular intervals, or upon the occurrence of certain events (e.g., system startup) or conditions (e.g., detection of declining sensitivity). In the first step 210, ions of a first type (referred to herein as analyte ions) are generated at ion source 105 and delivered along ion path 110 to mass analyzer 115. During this period, the voltages applied to the various ion transfer optic devices are set to establish axial potential gradients that urge the ions to travel along the full length of ion path 110 (with the possible exception of gate 155, which is periodically operated to inhibit the entrance of ions into mass analyzer 115 after a target population has been accumulated) into mass analyzer 115. In step 220 (which will typically occur concurrently with step 210), mass analyzer 115 is operated to measure the intensities of analyte ions arriving within an acquisition period, for example by ejecting the ions to a detector. Preferably, mass analyzer 115 detects both the total number of ions referred to as the total ion count, or TIC) and the variation of numbers of ions with m/z (i.e., mass spectra). In a pulsed mass analyzer such as the ion trap mass analyzer described herein, acquisition of TIC and/or mass spectra occurs as a series of operations in which the mass analyzer is filled with ions for a prescribed period of times, followed by ejection of the accumulated ions to the detector. Typically, a relatively large number of TICs/spectra may be acquired, and optionally averaged to achieve improved signal/noise ratio. These data may then be stored in the memory of the data and control system for comparison with subsequently acquired data, as described below.

In the next step 230, the delivery of the analyte ions to mass analyzer 115 is terminated, and ions of a second type, having a polarity opposite to that of the analyte ions, are generated and directed along a segment of the ion path that terminates at a first intermediate location $P_1$ upstream of mass analyzer 115. The ions of the second type are referred to herein as discharge ions; if we assume that the analyte ions are positively charged, then the discharge ions will be negatively charged. During this step 230, the voltages applied to ion source 105 and those ion transfer optic devices located upstream of the termination point are adjusted to promote the generation of discharge ions and their travel along the ion path segment. In order to prevent the further progress of the discharge ions through mass spectrometer 100 past the termination point, a blocking voltage is applied to the ion transfer optic device located immediately downstream in ion path 110 from the termination point, the blocking voltage being selected to establish an electric field that acts in the direction opposite to travel of discharge ions along ion path 110. In the example depicted in FIG. 1, the first intermediate location P1 is positioned just upstream of first multipole 135, and the travel of the discharge ions is stopped by applying a suitable blocking potential thereto. During step 230, a portion of the discharge ions (those that are not adequately focused/confined by the electric fields) impinge upon surfaces of the ion transfer optic devices located upstream of the termination point. The collision of discharge ions with the ion transfer optic devices surfaces results in the rapid neutralization of the accumulated charge arising from the prior impingement of (oppositely-charged) analyte ions. As discussed above, assuming that the ion optic transfer device(s) exposed to the discharge ions was previously charged, the neutralization of this charge will remove or reduce the amount of field aberration associated with the accumulated charge, and thereby increase transmission efficiencies, at least temporarily. The conditions at which the discharge ions are conveyed into and along the ion path segment, and more specifically the duration of exposure to the discharge ions, may be optimized in accordance with the instrument architecture and the amount of charging that is expected under existing instrument operational parameters. In a typical implementation, the duration of exposure to discharge ions in step 230 is around 30 seconds.

Following completion of the discharge step 230, analyte ions are again generated at ion source 105 and conveyed through ion transfer optic devices 120 to mass analyzer 115, step 240, in a manner substantially similar to that discussed above in connection with step 210. In step 250, mass analyzer 115 is operated to measure the intensities (preferably both the total number of ions as well as the mass spectra) of analyte ions arriving within an acquisition period, for example by ejecting the ions to a detector. Again, multiple analysis cycles may be conducted and averaged to improve the signal/noise ratio. These data are then stored in the memory of the data and control system.

Figure 3:
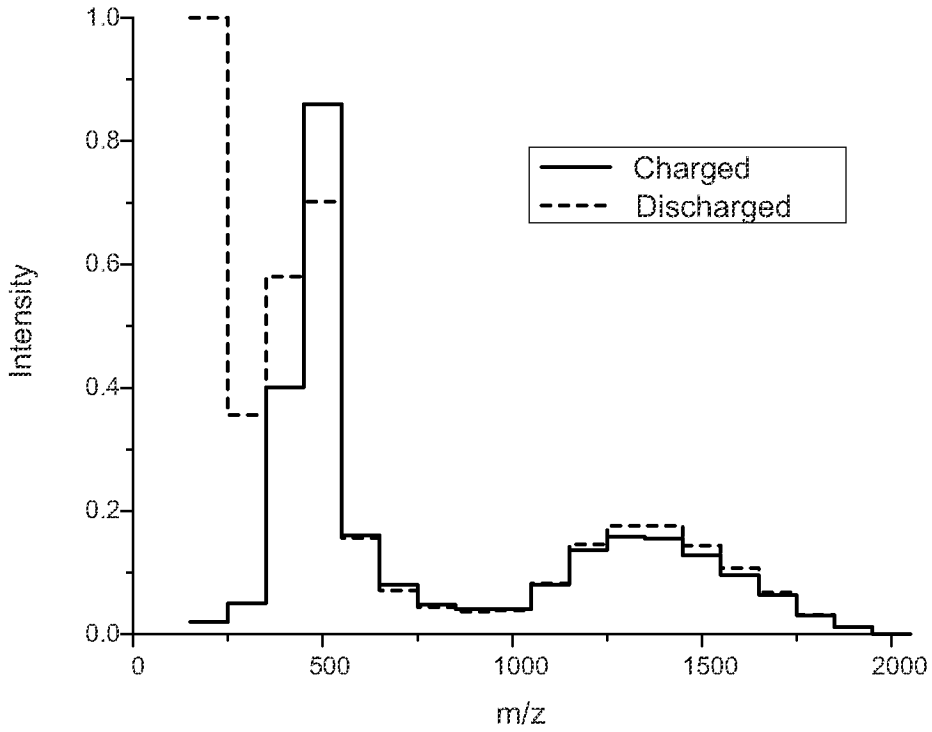
FIG. 3 is a graph showing the variation of measured ion intensity with m/z for charged and discharged conditions in a mass spectrometer.

In step 260, the analyte intensity data acquired in step 250 (following exposure of a subset of ion transfer optic components to discharge ions in step 230) is compared to the intensity data acquired in step 220 (prior to exposure to discharge ions) to determine if any increase in intensity is observed. This comparison step will typically involve determining whether the relative difference in intensities exceeds a specified threshold (which threshold may be user-supplied, or may be set in the software encoding the method). In a simple implementation, this step 260 may involve comparing only an averaged total ion count measured during the pre- and post-exposure periods. However, as discussed above, the effect of ion transfer optic device charging may be highly mass-dependent, with ion species having m/z's within one end of the range being disproportionately affected. For example, charging in high pressure regions of the instrument sometimes affects primarily low m/z ions, and allows high m/z ions to pass uninhibited, because ion transport in those regions is predominantly controlled by gas dynamics. In those regions of gas expansion, ions of all m/z's have the same velocity, and thus high m/z ions have more kinetic energy and are less prone to deflection. In contrast, charging in other regions can cause significant attenuation of high m/z ions while having little or no effect on the transmission of low m/z ions. An example of mass-dependence is depicted in FIG. 3, which shows the variation in intensities with m/z for ions measured in a mass spectrometer in charged (solid line) and discharged (dashed line) conditions. It may be discerned that the occurrence of charging of ion transfer optic devices in the ion path has only a small effect on the transmission of ions having m/z's in excess of about 500 Thomson, whereas the transmission of low m/z ions is significantly reduced in the charged condition relative to the uncharged condition. For this reason, comparing only the total ion count measured in steps 220 and 250 may produce misleading results, particularly where the disproportionately affected ions (e.g., low m/z ions in the current example) constitute a relatively small fraction of the total ions.

Thus, in an alternative and potentially preferred implementation, the comparison step 260 involves comparing the intensity measurements acquired in steps 220 and 250 (i.e., pre- and post-discharge) across a plurality of m/z values or range of m/z values, such that large changes in mass-dependent transmission may be more easily identified. It should be understood that it will typically not be necessary to make comparisons for each ion species (i.e., each m/z) detected during measurement; instead, one could perform this step by comparing measured intensities of ions within binned ranges of m/z. An alternative means of comparing the pre- and post-discharge spectra is to treat each spectrum as a vector, and measure their similarity, with a dot product based metric, like the cosine similarity score, which gives a measure of similarity of two vectors that ranges between 0 (unsimilar) to 1 (equal vectors). The cosine similarity of two vectors is given by:

$$\frac{A \cdot B}{\|A\|\|B\|}$$

where A and B are pre- and post-discharge spectra, A·B is their dot product, and ||A|| and ||B|| are the lengths of these vectors, defined as $$\|A\| = \left(\sum_{i=1}^{N} a_i^2\right)^{\frac{1}{2}}.$$

In any case, the comparison of ion intensities measured in steps 220 and 250 will yield a determination of whether the discharge step 230 resulted in an increased transmission of analyte ions, which supports an inference that charging was occurring somewhere in the subset of ion transfer optic components exposed to the discharge ions in the previous step. While the FIG. 2 flowchart shows the comparison/charging determination step 260 occurring following each sequence of discharge/re-measurement steps, other implementations may defer the comparison/charging step until all discharge re-measurement steps are completed.

The steps of directing discharge ions along a segment of the ion path, step 230 and subsequently re-measuring the intensities of the analyte ions, steps 240 and 250 may then be repeated for each of a plurality of intermediate points $P_2 \ldots P_N$ representing the terminus of the segment of the ion path reached by the discharge ions. Each intermediate point $P_i$ extends farther along ion path 110 relative to the prior intermediate point $P_{i-1}$, such that during each successive discharge/measurement sequence, at least one additional ion transfer optic device is exposed to the discharge ions. As described above, limiting the travel of the discharge ions to a particular intermediate point $P_i$ is effected by applying a blocking voltage to an ion transfer optic device located immediately downstream in ion path 110 from $P_i$. At step 260, the re-measured analyte ion intensity is compared to a previously measured intensity (e.g., the intensity measured in the immediately prior sequence of discharge/re-measurement steps 230-250) to determine if an increase in intensity has been observed; as discussed above, the compared intensities may represent the total ion intensities, or corresponding intensities across a plurality of m/z values.

Referring again to FIG. 1, a set of intermediate points $P_1$ to $P_9$ are arranged along ion path 110 of mass spectrometer, corresponding to the sequence in which ion transfer optic devices are exposed to the discharge ions. $P_1$ is located adjacent to SRIG exit lens 130, $P_2$ is located adjacent to first RF multipole 135, $P_3$ is located adjacent to first lens 140, $P_4$ is located adjacent to second RF multipole 145, $P_5$ is located adjacent to second lens 150, $P_6$ is located adjacent to gate 155, $P_7$ is located adjacent to third RF multipole 160, $P_8$ is located adjacent to trap front lens 165 and $P_9$ is located adjacent to trap center lens 170. In this arrangement, each successive intermediate point defines an ion path segment that includes one additional ion transfer optic device 120 relative to the segment defined by the previous intermediate point. It should be recognized that other implementations of the invention may utilize a greater or lesser number of intermediate points, depending on considerations of (inter alia) instrument architecture, the desired specificity of the test results, and restrictions on the total time available to perform the charge localization method.

Figure 4A:
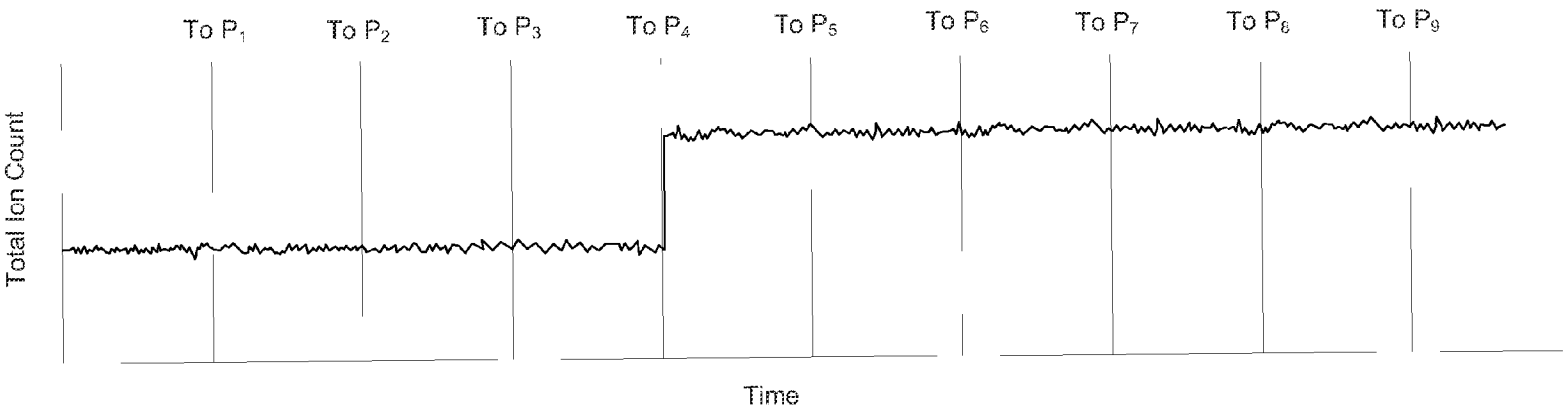
FIGS. 4A and 4B are graphs respectively showing total ion count and mass intensity ratios measured before and after a series of discharge events, wherein the mass spectrometer is experiencing contamination and charging of one of the ion transfer optic devices.
Figure 4B:
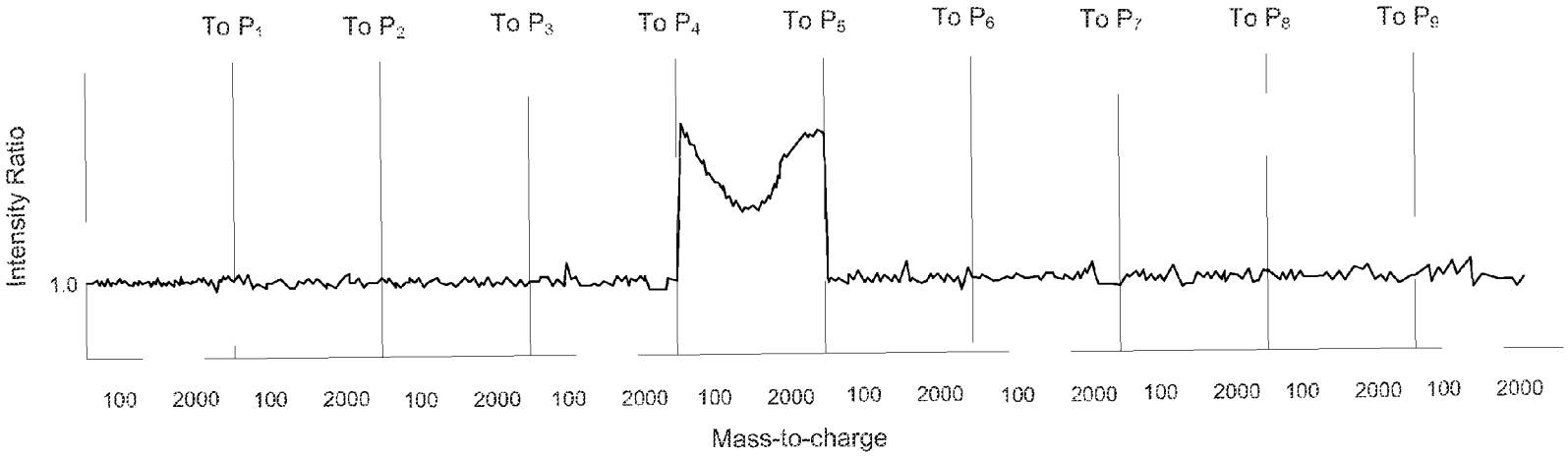

The presence and location of charging within mass spectrometer 100 may be easily discerned from the comparison results obtained in the iterations of steps 230-250. More particularly, if an increase in the re-measured analyte ion intensity, relative to the previously measured intensity, is observed after delivery of discharge ions to an intermediate point $P_i$ in the ion path, then it can be inferred that charging is occurring at the ion transfer optic device(s) located in the differential path segment (the portion of the ion path segment, terminating at an intermediate point $P_i$ that extends beyond the ion path segment terminating at preceding intermediate point $P_{i-1}$). This process may be more easily understood with reference to FIGS. 4A and 4B, which respectively show example results consisting of total ion count and mass-dependent intensity ratios measured before and after discharge events. The discharge events are represented as vertical lines, and are labeled with the intermediate point $P_i$ at which the travel of the discharge ions terminate, as shown in FIG. 1. Inspection of FIG. 4A shows that the measured total ion count remains substantially constant until the discharge event in which discharge ions are directed along the ion segment terminating at $P_4$, after which the measured total ion count increases substantially. This result indicates that charging is occurring in first RF multipole 135, which is located within the differential path segment associated with intermediate point $P_4$. FIG. 4B, which depicts the corresponding ion intensity (the ratio of measured ion intensity relative to the intensity measured before the most recent discharge event) across the scanned range of m/z values, shows that the ion count ratio is close to unity prior to the discharge event that produces the increase in total ion count. Following this event, the ratio increases substantially above unity, particularly for ions having relatively low and high m/z's in the measured range (with lesser increases toward the middle of this range).

After completion of all iterations of discharge/measurement/comparison steps 230-260 in FIG. 2, the results may be graphically or textually displayed to the user, step 270. This step may consist simply of displaying graphs showing the measured intensities and/or intensity ratios before and after discharge, similar to the graphs depicted in FIGS. 4A and 4B, or may take the form of a warning or diagnostics report identifying which of the ion transfer optic devices (if any) have been determined to be experiencing charging. The instrument operator may then take corrective action based on this information, for example cleaning the affected device(s) to remove accumulated contamination. The control and data system may also store and log results each time the charging localization method is run, and this information may be useful to instrument designers by way of identifying devices that are prone to contamination and charging, such that appropriate changes to the design and operation of the mass spectrometer may be made to avoid recurring problems. In some implementations, the control and data system may be programmed to automatically terminate further data acquisition upon a determination that charging is occurring.

Several important parameters can determine the effectiveness of method described above. An important one is the intensity, or flux, of the discharging ion beam. In the foregoing examples of positive ion charging, the discharging ion beam is negative ions. If the flux of the negative ion beam is very low, then the discharging effect may be very small, are even unobservable, in the time frame of this method. A low ion flux can be caused by several factors including inadequate tuning conditions, incorrect source settings for negative ions, or a low concentration of sample molecules that can be made negatively charged. Consequently, in order to gauge the significance of the data, it is useful to have a measurement of the flux of the negative ion beam especially with respect to the positive ion beam flux. In one implementation, the ratio of these two beams (analyte and discharge ions) can be displayed in the output of the diagnostic for this purpose.

The charging process itself can vary dramatically in its time dependency. The time which is required to show charging effects is both effected by the ion flux, but also by the nature of the contamination to hold and/or dissipate charge. Consequently, a careful selection of the exposure time and conditions to the discharging process is required. We have chosen a 30 second discharging time interval which utilizes 100 ms injection times for each scan, to give us a reasonable compromise in terms of the ability of observing a typical charging situation, and the time for the diagnostic to run.

One additional optimization of the method involves the mass spectral scan rate. On systems such as quadrupole ion trap systems, where there are various mass spectral scan rates available, a fast (short scan time, low relative resolution) mass spectra scan rate can be utilized, to speed up the overall diagnostic procedure without affecting the legitimacy of the result.

It should be understood that while the method has been described above with reference to a particular mass spectrometer architecture, it should not be construed as limited thereto, but instead may be utilized in connection with any number of different mass spectrometer instruments.

It is more generally understood that the foregoing description is intended to illustrate rather than limit the scope of the invention, which is defined by the appended claims.

What is claimed is:

1. A method for identifying the location of charging in a mass spectrometer having a plurality of ion transfer optic devices arranged along an ion path extending from an ion source to a mass analyzer, the method comprising:

directing ions of a first type along the ion path and measuring the intensities of the ions of the first type arriving at the mass analyzer; and performing, for each of plurality of intermediate locations disposed along the ion path, a discharge/measurement sequence comprising the steps of:

directing ions of a second type, having polarities opposite to the ions of the first type, along a segment of the ion path terminating at a selected intermediate location $P_i$, the intermediate location $P_i$ for each i>1 being disposed further downstream in the ion path relative to a previously selected intermediate location $P_{i-1}$, wherein the ions of the second type are prevented from traveling past the intermediate location $P_i$ by applying a blocking potential to selected one or more of the plurality of ion transfer optic devices; and subsequently directing ions of a first type along the ion path and measuring the intensities of the ions of the first type arriving at the mass analyzer.

2. The method of claim 1, further comprising a step of determining, for each discharge/measurement sequence, whether a change in the measured intensities has occurred relative to the measured intensities corresponding to the previous discharge/measurement sequence.

3. The method of claim 2, further comprising identifying at least one ion transfer optic device experiencing charging based on the determination of a change in the measured intensities.

4. The method of claim 2, wherein the step of determining whether a change in the measured intensities has occurred comprises comparing measured total ion counts.

5. The method of claim 2, wherein the step of determining whether a change in the measured intensities has occurred comprises comparing the measured intensities of ions at a plurality of mass-to-charge ratios.

6. The method of claim 1, further comprising displaying the intensities measured for each discharge/measurement sequence.

7. The method of claim 1, further comprising displaying indicia representing an identified location of charging.

8. The method of claim 1, wherein the ions of the first and second types are generated by a common ion source.

9. The method of claim 8, wherein the ions of the first and second types are generated from a common sample stream.

* * * * *

UNITED STATES PATENT AND TRADEMARK OFFICE

CERTIFICATE OF CORRECTION

PATENT NO. : 9,293,312 B2
APPLICATION NO. : 14/216507
DATED : March 22, 2016
INVENTOR(S) : Philip M. Remes et al.

It is certified that error appears in the above-identified patent and that said Letters Patent is hereby corrected as shown below:

In the Claims
Claim 1, column 10, line 5:
replace "applying a blocking potential to selected one or more"
with --applying a blocking potential to a selected one or more--

Signed and Sealed this
Twenty-sixth Day of July, 2016

Michelle K. Lee

Michelle K. Lee
*Director of the United States Patent and Trademark Office*